US007011233B2

(12) United States Patent
Drennow

(10) Patent No.: US 7,011,233 B2
(45) Date of Patent: Mar. 14, 2006

(54) DEVICE AT PACKAGES, COUPLING MEMBERS AND METHOD FOR APPLICATION OF A COUPLING MEMBER

(75) Inventor: Sten Drennow, Lund (SE)

(73) Assignee: Asept International AB, Lund (SE)

( * ) Notice: Subject to any disclaimer, the term of this patent is extended or adjusted under 35 U.S.C. 154(b) by 193 days.

(21) Appl. No.: 10/381,649

(22) PCT Filed: Sep. 27, 2001

(86) PCT No.: PCT/SE01/02079

§ 371 (c)(1),
(2), (4) Date: Mar. 26, 2003

(87) PCT Pub. No.: WO02/26586

PCT Pub. Date: Apr. 4, 2002

(65) Prior Publication Data

US 2004/0011426 A1 Jan. 22, 2004

(30) Foreign Application Priority Data

Sep. 29, 2000 (SE) ..... 0003489

(51) Int. Cl.
*B65D 35/056* (2006.01)

(52) U.S. Cl. ..... 222/105; 222/383.1; 222/215

(58) Field of Classification Search ..... 222/74, 222/82–83.5, 105, 107, 153.06, 183, 325, 222/326, 386, 386.5, 89, 383.5
See application file for complete search history.

(56) References Cited

U.S. PATENT DOCUMENTS

| | | | | | |
|---|---|---|---|---|---|
| 4,416,395 | A | * | 11/1983 | Gaubert | 222/83 |
| 4,568,321 | A | | 2/1986 | Gaubert | |
| 4,576,313 | A | * | 3/1986 | Smith et al. | 222/81 |
| 4,603,793 | A | * | 8/1986 | Stern | 222/105 |
| 5,452,826 | A | | 9/1995 | Stern | |
| 5,819,986 | A | * | 10/1998 | Last et al. | 222/95 |
| 6,082,584 | A | | 7/2000 | Stern | |
| 6,109,315 | A | | 8/2000 | Stern | |

FOREIGN PATENT DOCUMENTS

| | | | |
|---|---|---|---|
| SE | 514699 | A1 | 3/1999 |
| SE | 515112 | A1 | 3/1999 |
| WO | WO8101992 | A1 | 7/1981 |
| WO | WO0226586 | A1 | 4/2002 |

* cited by examiner

*Primary Examiner*—Frederick Nicolas
*Assistant Examiner*—Melvin A Cartagena
(74) *Attorney, Agent, or Firm*—Tarolli, Sundheim, Covell & Tummino L.L.P.

(57) ABSTRACT

The present invention relates to a device at packages, coupling members and method for application of a coupling member. The device comprises coupling members (4, 8) with non-circular coupling portions (5, 9) which fit together only if they have the same non-circular shape. The non-circular coupling portions (5, 9) are also located relative to the package (1) such that a conduit (13) for discharging product (3) from the package (1) attains a predetermined position in relation thereto or the conduit (13) can be rotated to such a position.

20 Claims, 7 Drawing Sheets

Fig.9
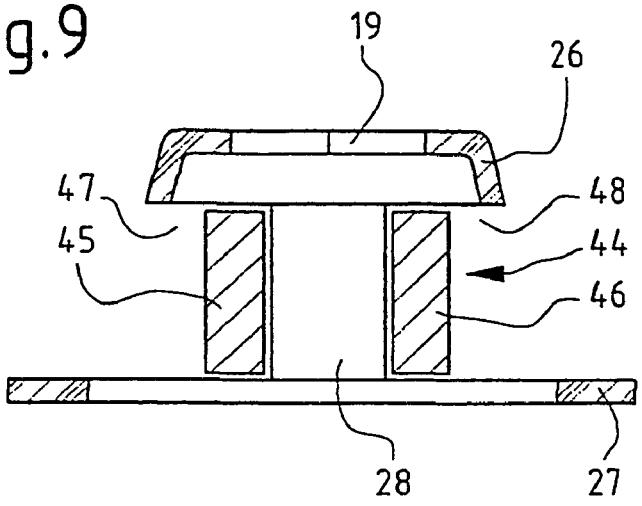
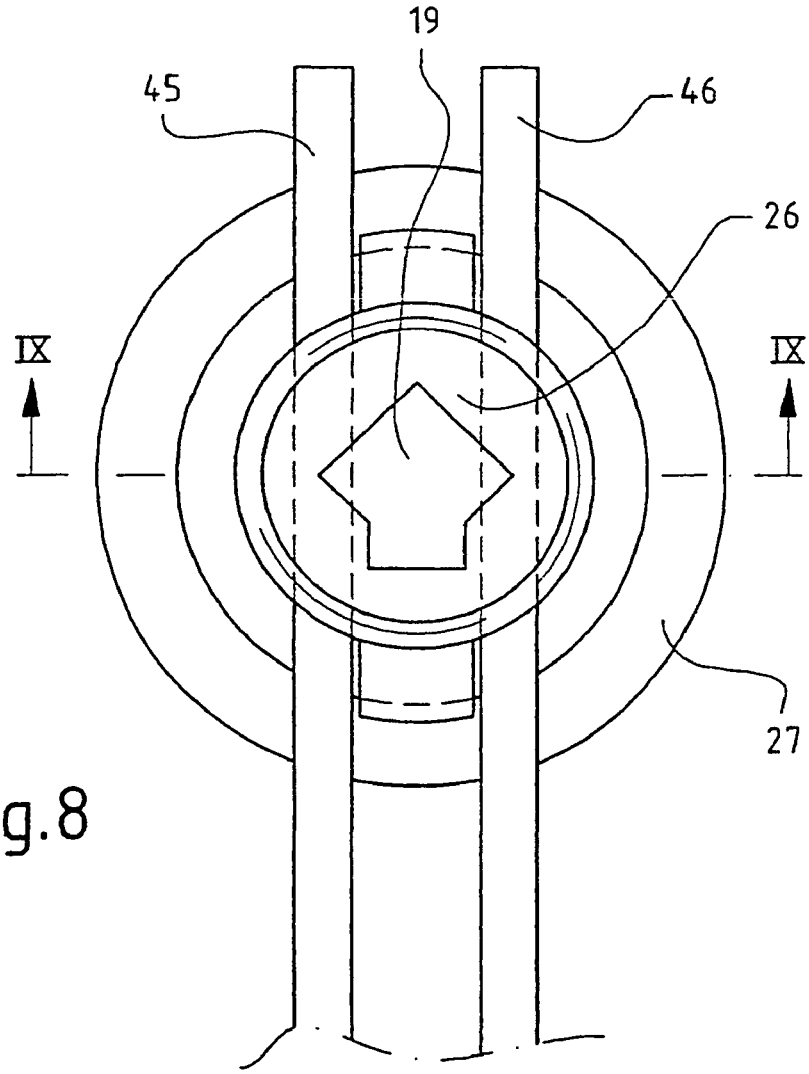
Fig.8

DEVICE AT PACKAGES, COUPLING MEMBERS AND METHOD FOR APPLICATION OF A COUPLING MEMBER

FIELD OF THE INVENTION

The present invention relates to a device at packages, coupling members and a method for application of a coupling member. At the device according to the invention the packages are adapted for location in a container, wherein the package is made of synthetic material, wherein a discharge or outfeed device is provided to discharge a liquid or semi-liquid product, e.g. ketchup, mustard, mayonnaise and similar or skin cream, shampoo, soap and similar or medicine, from the package when said package is located in the container, wherein the package comprises a coupling member with a coupling portion, wherein the coupling member is located in the package such that it will be situated at the bottom of the container when the package is located therein, wherein the discharge device comprises a conduit for feeding product coming from the package, wherein the conduit includes a coupling member with a coupling portion, wherein the coupling member of the package is located within an unbroken portion of the wall of the package and wherein the coupling members of the package and the discharge device can be connected to each other by bringing the coupling portion of the coupling member of the discharge device to penetrate the unbroken portion of the wall of the package and then bring it to cooperate with the coupling portion of the coupling member of the package such that said coupling members are interconnected.

BACKGROUND OF THE INVENTION

The publication EP 0 042 857 describes a package of the abovementioned type. This package is located in a container and there is a coupling device similar to the abovementioned coupling device. The publication U.S. Pat. No. 6,109,315 describes a coupling device at packages. According to this publication, the coupling device may include oval coupling portions. The publication U.S. Pat. No. 5,452,826 describes a package which is located in a container and there is a pump device for pumping out a product in the package.

None of said publications describes a device which, on one hand, minimizes the risk of connecting the wrong discharge device to the package or vice versa and, on the other hand, solves the problem that the conduit for connection to the package for discharging the product therefrom, during connection, attains an appropriate orientation relative to the package.

SUMMARY OF THE INVENTION

The object of the present invention is to provide a device eliminating the abovementioned drawbacks and this is achieved while the initially defined device has been given the characterizing features described below. Suitable coupling members have the characterizing features described below and a method for applying a coupling member to the package is defined below.

Since the device has been given said characterizing features, a substantial reduction of the risk that the wrong discharge device is connected to the package or vice versa is reached. Additionally, an appropriate orientation relative to the container is obtained when the package is brought into said container along with the conduit, whereby a full package with associated discharge device more easily and quicker can be located in and on respectively, the container.

BRIEF DESCRIPTION OF THE DRAWINGS

The invention will be further described below with reference to the accompanying drawings, in which:

FIG. 8 schematically illustrates a control device for guiding the coupling member of the package such that it is held in a predetermined position during location of the package; and FIG. 9 is a section IX—IX through the control device and coupling member of FIG. 8.

DESCRIPTION OF EXAMPLE EMBODIMENTS

Figure 1:
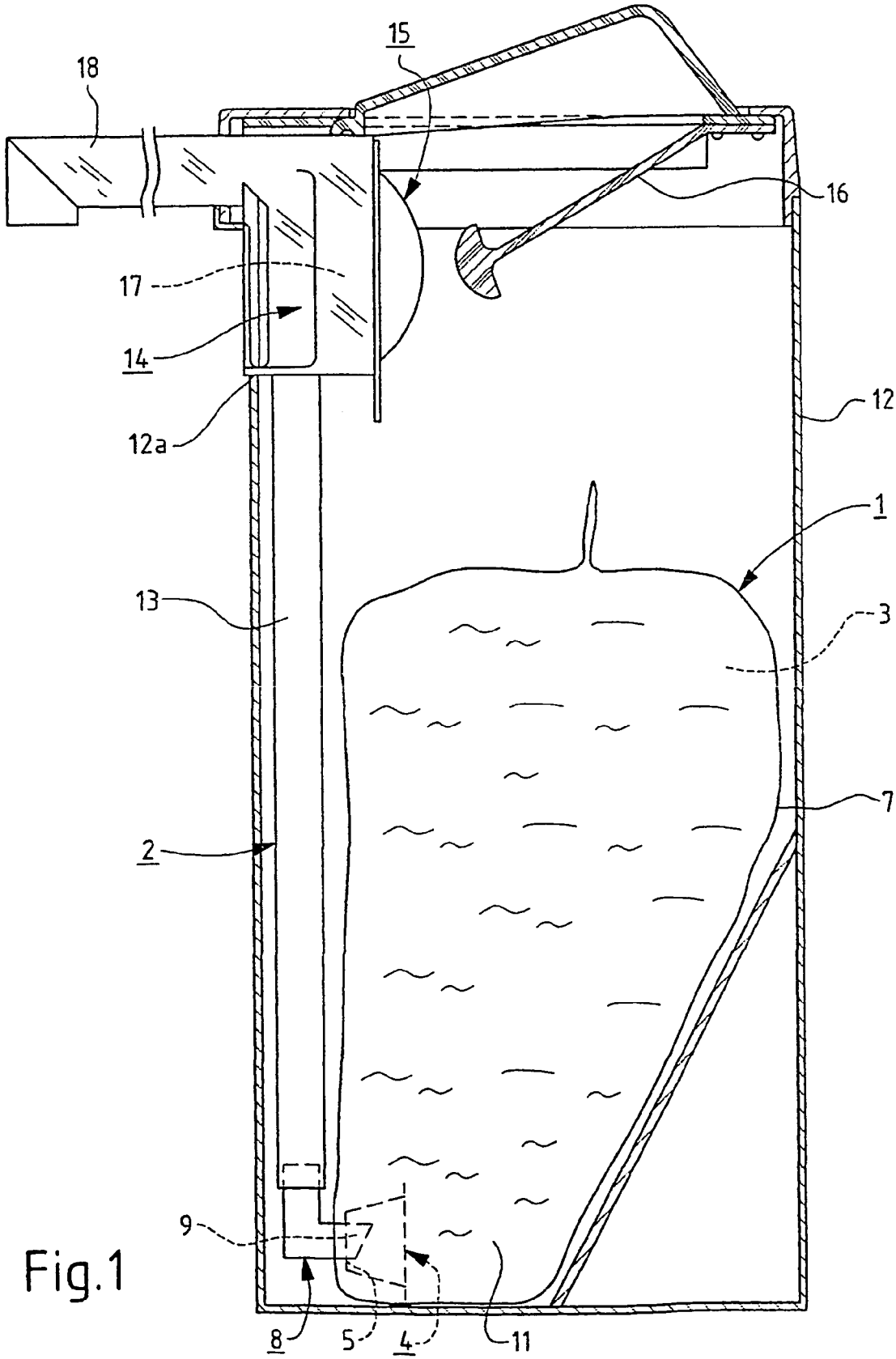
FIG. 1 is a side view of a package and a discharge device, wherein the package and the discharge device are interconnected by means of a device according to the invention.
Figure 2:
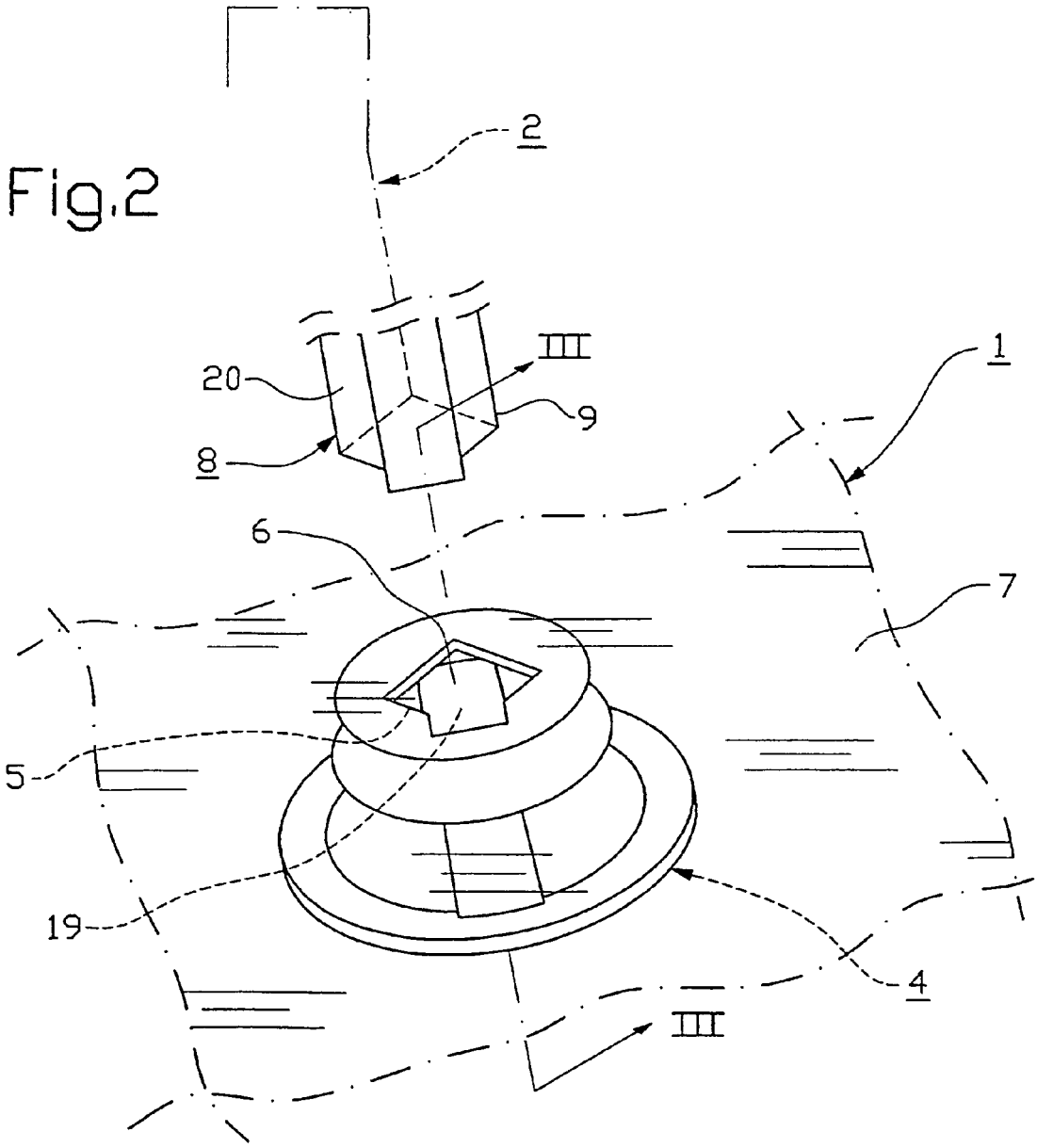
FIG. 2 is a perspective view of coupling members forming part of the device according to the invention.
Figure 3:
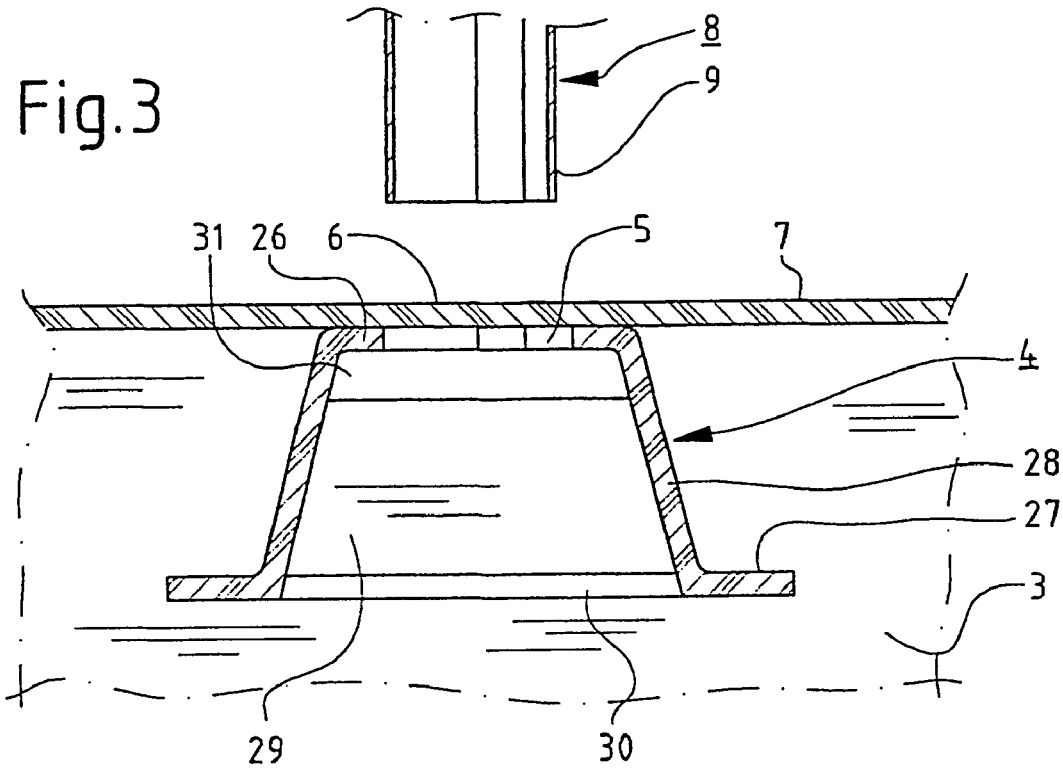
FIG. 3 is a section III—III through the coupling members of FIG. 2.

In FIG. 1 there is illustrated a package 1 and a discharge or outfeed device 2 for discharging the product 3 in the package 1. The package 1 is made of a synthetic material and the product 3 therein is liquid or semi-liquid. Examples of products 3 in the package 1 are foodstuff, e.g. ketchup, mustard, mayonnaise and similar. Alternatively, the package 1 can contain skin cream, shampoo, soap or medicine.

The discharge device 2 can be connected to the package 1 for discharge of said product 3 therefrom. In order to carry through this interconnection of the discharge device 2 and the package 1, a coupling member 4 is located in the package 1. This coupling member 4 includes a coupling portion 5 and it is located on an unbroken portion 6 of the wall 7 of the package 1. This discharge device 2 includes a coupling member 8 with a coupling portion 9, said coupling member 8 being connected to the coupling member 4 of the package 1 by bringing it to penetrate the unbroken portion 6 of the wall 7 of the package 1. When the unbroken portion 6 of the wall 7 is broken, the coupling portion 9 of the coupling member 8 is brought to cooperate with the coupling portion 5 of the coupling member 4 of the package 1 such that the coupling members 4, 8 are interconnected.

Figure 4:
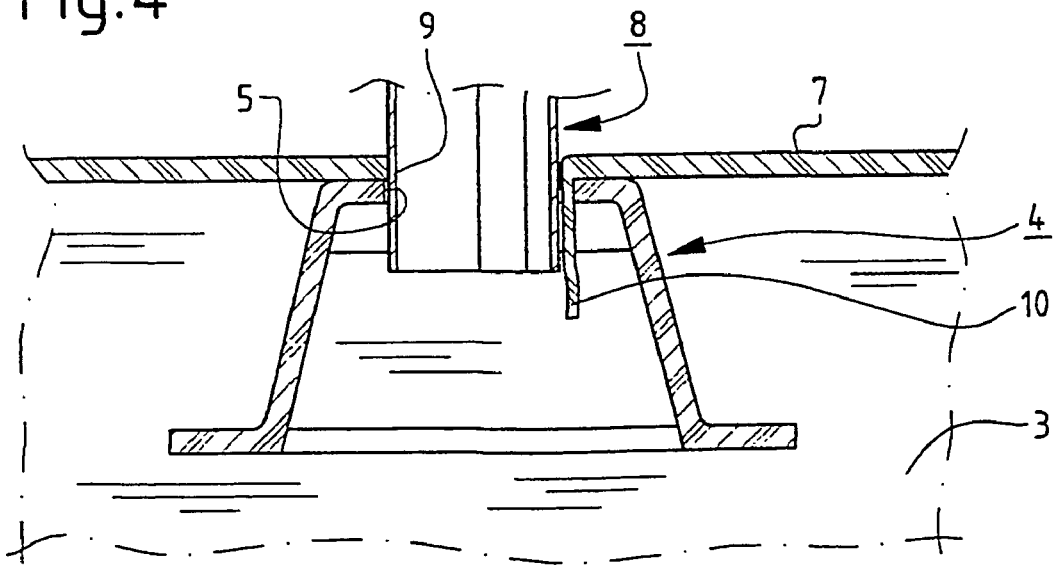
FIG. 4 is a side view of the coupling members of FIG. 2 after connection to each other.

When the coupling portion 9 of the coupling member 8 of the discharge device 2 penetrates the unbroken portion 6 of the wall 7, one or more lugs 10 of wall material can be bent inwards such that the lug or lugs 10 will be situated between the coupling portions 5, 9 of the coupling members 4, 8 (see FIG. 4).

The coupling portions 5, 9 of the coupling members 4, 8 have such shape that they attach to each other when said coupling members 4, 8 are interconnected and they cooperate with each other such that a liquid-tight connection is obtained between said members.

Since the unbroken portion 6 of the wall 7 has been penetrated during the interconnection of the coupling members 4, 8, the package 1 has also been opened such that the product 3 therein can be discharged or dispensed through the discharge device 2.

In order to prevent interconnection of a package 1 and a discharge device 2 not belonging thereto, i.e. to prevent that a package 1 with a certain product 3 is connected to a discharge device 2 for discharge of another product 3, the package 1 and the discharge device 2 are interconnectable to obtain the liquid-tight connection therebetween only if the coupling portions 5, 9 of their coupling members 4, 8, have non-circular shapes which are adapted to each other.

The non-circular shape of the coupling portion 5 on the coupling member 4 of the package 1 is preferably chosen such that if e.g. a coupling portion 9 with a circular or other unfit shape on a coupling member 8 on a discharge device 2 is connected to said non-circular coupling portion 5 on the coupling member 4 of the package 1, a) it is not possible to interconnect the coupling portions 5, 9 of the coupling members 4, 8 such that they attach to each other and/or b) after interconnection of the coupling portions 5, 9 of the coupling members 4, 8, gaps appear between said coupling portions 5, 9 such that the product 3 leaks out of the package 1 through said gaps.

The coupling portion 5 on the coupling member 4 of the package 1 preferably has such a non-circular shape that one through an ocular inspection can determine that the coupling portion 9 on the coupling member 8 of the discharge device 2 does not fit together with the coupling portion 5 on the coupling member 4 of the package 1.

If the coupling member 4 of the package 1 is located in a package 1 of opaque wall material, there may be, on the outside of the wall material, a figure with the shape of the non-circular coupling portion 5. This figure is preferably found at that spot where the unbroken portion 6 of the wall 7 of the package 1 is to be broken.

The coupling member 4 of the package 1 is preferably provided on the package 1 such that the coupling portion 5 on the coupling member 4 of the package 1, in view of its non-circular shape, has a certain fixed orientation relative to the package 1. The coupling member 8 of the discharge device 2 is preferably provided on said discharge device 2 such that the coupling portion 9 on the coupling member 8 of the discharge device 2, with regard to its non-circular shape, has a certain fixed orientation relative to the discharge device 2.

The coupling portions 5, 9 of said coupling members 4, 8 preferably have such a non-circular shape that they must be brought to or set in certain fixed positions relative to each other to permit interconnection thereof.

The coupling members 4, 8 of the package 1 and the discharge device 2 can be located, with regard to their non-circular shapes, such that their coupling portions 5, 9 can be interconnected only if the package 1 and the discharge device 2 before interconnection of the coupling members 4, 8 are placed in those positions relative to each other that they shall occupy after interconnection of the coupling portions 5, 9.

At the embodiment illustrated in the drawings, the package 1 is elongated and its coupling member 4 located at an end portion 11 thereof, namely the end portion 11 facing downwards when the package 1 is placed in a container 12 or similar. At the embodiment shown, the discharge device 2 has an elongated conduit 13, e.g. a hose. The coupling member 8 is located on one end of the hose 13 while the other end of said hose 13 is connected to a pump device 14 which e.g. may be constructed as a suction and pump device 14 such that the product 3 can be brought to flow from the coupling member 8 through the hose 13 to said suction and pump device 14. This suction and pump device 14 comprises an elastic suction and pump means 15 which can be affected by means of a manually operable pump member 16 for reduction of the volume of a suction and pump chamber 17. Thereby, that portion of the product 3 which has been sucked out of the package 1 is pumped through the hose 13 to the suction and pump chamber 17 and out of said chamber through a discharge pipe 18 or similar. The suction and pump means 15 is designed to regain its original shape when it is no longer affected by the pump member 16, whereby a portion of the product 3 is sucked out of the package 1 to the suction and pump chamber 17. At the embodiment shown, the suction and pump device 14 is brought down into an upwardly open groove 12*a* in the upper parts of the container 12 such that the suction and pump device 14 is fixed in that position relative to the container 12. The hose 13 extends downwards from the suction and pump device 14 and is down below connected to the coupling member 4 of the package 1 through the coupling member 8.

The package 1 and the discharge device 2 are interconnected before they are placed in the container 12. This is done e.g. by placing the package 1 on a support with its coupling member 4 directed upwards, whereby one must be able to see where the coupling member 4 is located for connection to the coupling member 8 of the discharge device 2. If the package 1 is made of transparent material one can directly see where the coupling member 4 is located in the package 1. If the package 1 is opaque, one can see on the outside of the package 1 where the coupling member 4 is attached. Eventually, there may be a mark on the outside of the package 1 for showing where the coupling member 4 is located in the package 1.

For connection of the coupling member 8 of the discharge device 2 to the coupling member 4 of the package 1, said former coupling member 8 is pressed through the unbroken portion 6 of the wall 7 of the package 1. Hereby, the non-circular coupling portions 5, 9 of the coupling members 4, 8 are located such that they can be connected to each other when the hose 13 is held in parallel or substantially in parallel with the longitudinal direction of the package 1, but not when the hose 13 is not held in said position relative to the package 1.

Figure 5:
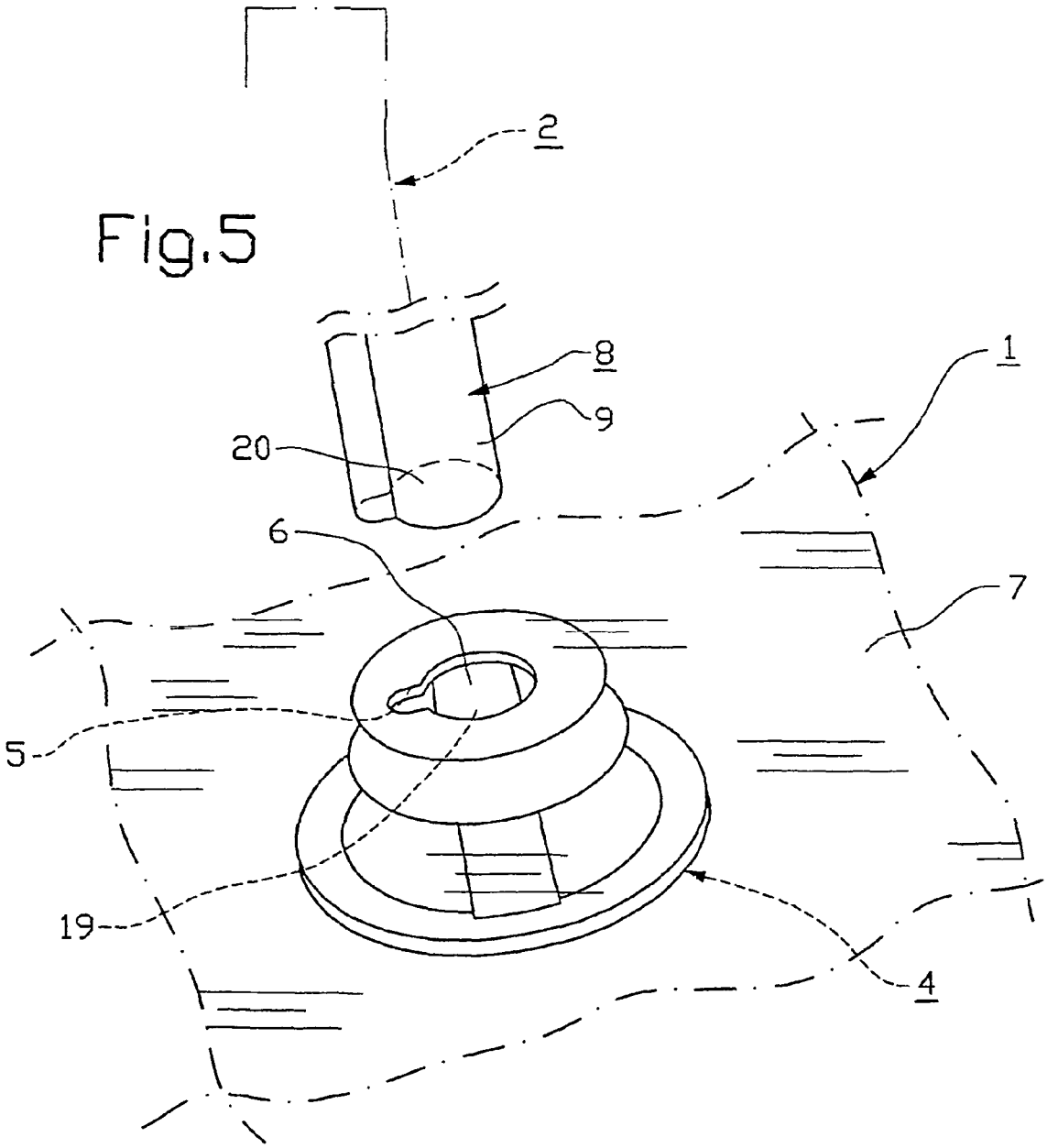
FIG. 5 is a perspective view of alternatively designed coupling members forming part of the device according to the invention.

The coupling portion 5 of the coupling member 4 of the package 1 preferably defines a non-circular opening 19 and the coupling portion 9 of the coupling member 8 of the discharge device 2 is shaped as a tube member 20 having such non-circular cross-sectional shape that it fits into said opening 19. The non-circular shape of the coupling portions 5, 9 can be any non-circular shape. Examples of non-circular shapes are polygonal shapes, e.g. trilateral, quadrilateral, pentagonal, hexagonal, heptagonal or octahedral shapes. The non-circular shape may alternatively be e.g. an irregular oval as is shown in FIG. 5 or partly circular and partly non-circular.

The coupling members 4, 8 may be fixedly attached to the package 1 and discharge device 2 respectively, as is shown in the figures. Alternatively, the coupling members 4, 8 of the discharge device 2 and/or the package 1 and/or their coupling portions 5, 9 may be rotatably mounted such that they may be rotated or rotate relative to the discharge device 2 and/or the package 1 prior to and/or after the interconnection of the coupling members 4, 8.

Figure 6:
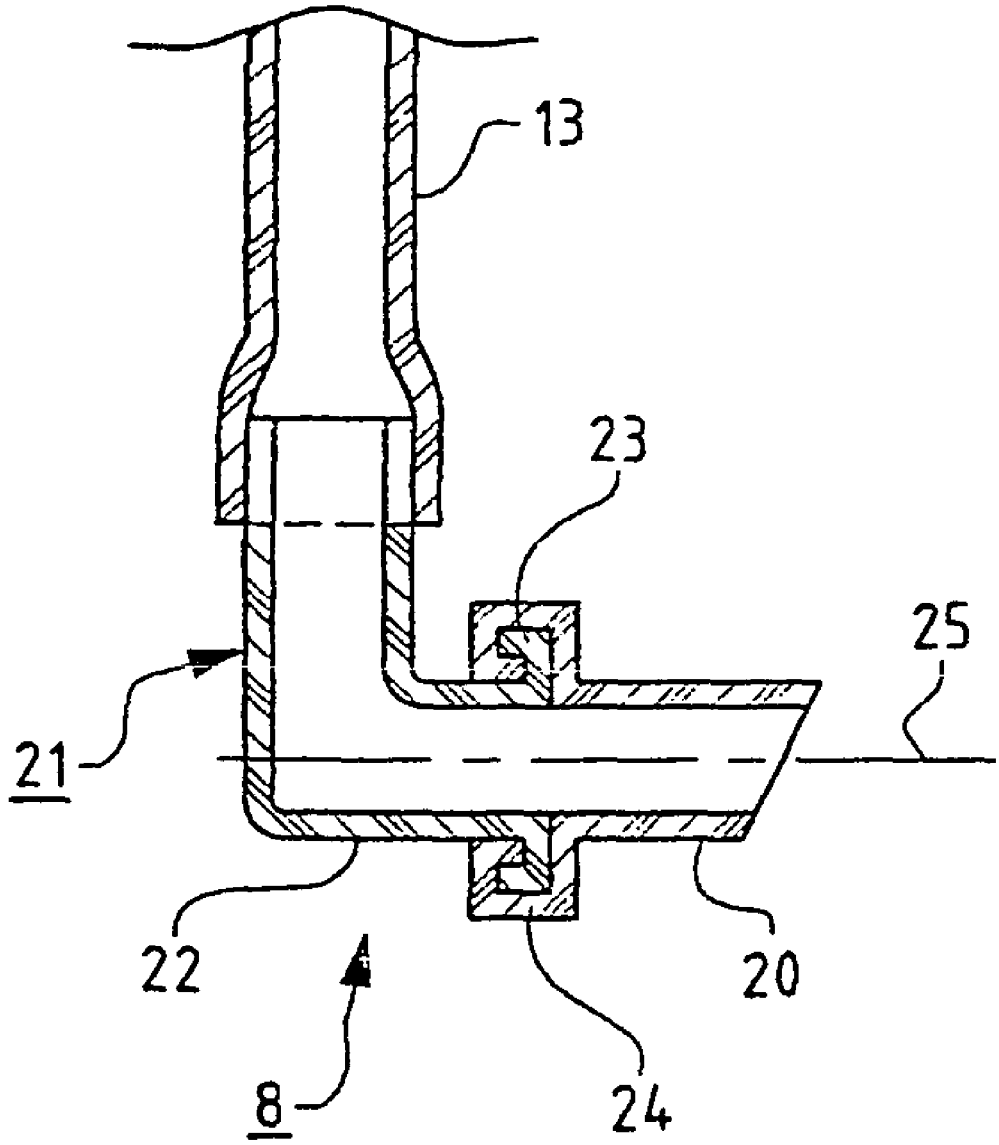
FIG. 6 is a section through an alternatively designed lower part of the discharge device.

An example of a rotatable coupling member 8 on the discharge device 2 is illustrated in FIG. 6. At this construction, the discharge device 2 includes an elbow-pipe piece 21, the upper end of which is provided on the hose 13 and which down below has a laterally directed part 22. This laterally oriented part 22 has an outwardly directed flange 23 and the tube member 20 also has an outwardly directed flange 24. The outwardly directed flanges 23, 24 connect to each other such that the laterally directed part 22 and the tube member 20 are rotatably connected to each other such that they can rotate about an imaginary line 25 in parallel with the direction of movement of the coupling member 8 when said coupling member 8 is connected to the coupling member 4.

The hose 13 may be workable—e.g. elastic—in such a way that it permits rotation of the coupling member 8 about the imaginary line 25.

The coupling member 4 of the package 1 may have different shapes. A suitable shape is that it comprises an outer part 26 which is provided on the unbroken portion 6 of the wall 7 of the package 1. This outer part 26 defines the coupling portion 5 on the coupling member 4 of the package 1. The coupling member 4 of the package 1 further comprises an inner annular part 27 which is located within the outer part 26.

The outer part 26 and the inner annular part 27 are connected to each other by means of at least connecting parts 28 between which there are openings 29 for through-flow of the product 3.

The inner annular part 27 has a circular or substantially circular opening 30 for the product 3 and a circular or substantially circular outer edge.

The diameter of the outer edge of the outer part 26 is substantially equal to or less than the diameter of the outer edge of the inner annular part 27. The two connecting parts 28 are located opposite each other and they are connected to the outer part 26 at its outer edge and to the inner circular part 27 at its opening 30.

The outer part 26 may have a collar 31 which is directed in towards the inner annular part 27 and the connecting parts 28 can be connected to an inner edge of said collar 31.

Thus, the non-circular coupling portion 5 of the coupling member 4 of the package 1 is oriented so relative to the package 1 that the non-circular coupling portion 9 of the coupling member 8 of the hose 13 can be connected to the coupling portion 5 of the coupling member 4 of the package 1 only when the hose 13 is in a predetermined position relative to the package 1 or can be brought into said predetermined position relative to the package 1. Thus, the package 1 can be located in the container 12 together with the hose 13 such that said hose 13, when situated in said predetermined position relative to the package 1, holds a predetermined position relative to the container 12.

Figure 7:
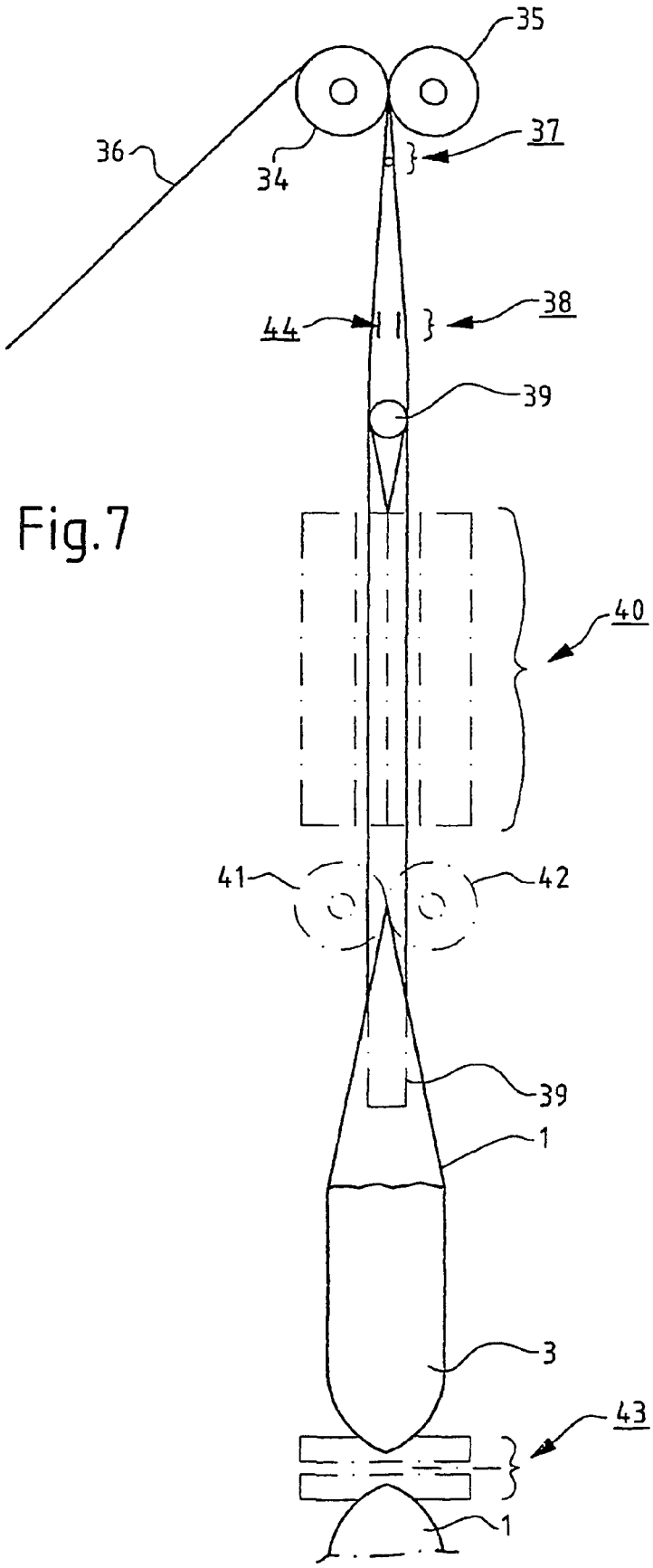
FIG. 7 illustrates with a schematic side view a packing device in which a coupling member is located in the package.

In FIG. 7, certain parts of a device for forming the package 1 and filling it with the product 3 are illustrated. This device includes two rolls 34, 35 between which a double web 36 runs in downward direction. Beneath the rolls 34, 35 there is a slitting station 37 for slitting the web 36 and beneath that a station 38 for insertion of the coupling member 4 of the package 1 through the slit and for attachment of the coupling member 4 of the package 1 to the inner side of the wall 7 of the package 1. A filler pipe 39 for filling the package 1 with the product 3 protrudes through the slit and is directed downwards and opens into the package 1 beneath a longitudinal-weld station 40. This is adapted to weld up the slit for obtaining a package 1 which is sealed in the longitudinal direction thereof.

Beneath the longitudinal-weld station 40 there are two rolls 41, 42 beneath which the package 1 is filled with the product 3. Beneath the filled package 1 there is provided a transversal-weld and cutting station 43 which is adapted for transversal welding of open transverse portions of the package 1 and for cutting the continuous packages 1 to separate packages.

At the station 38 for insertion and attachment of the coupling member 4, there is provided a schematically illustrated control device 44 with two control or guide means 45, 46. This control device 44 is adapted to guide the coupling member 4 of the package 1 such that its coupling portion 5 attains a predetermined orientation, in view of its non-circular shape, relative to the package 1 when it is located therein. Hereby, the coupling member 4 can be brought to slide on the guide means 45, 46, whereby said guide means e.g. may engage two U-shaped grooves 47, 48 which—seen from the side towards the coupling member 4—are defined by the outer part 26, the inner annular part 27 and the connecting parts 28 of the coupling member 4. During this guidance, the coupling member 4 can slide on the guide means 45, 46 until the coupling portion 5 engages the unbroken portion 6 of the wall 7 of the package 1 and can be attached thereto.

The invention is not limited to the embodiments described above and illustrated in the drawings, but its construction and function may vary within the scope of the subsequent claims. Thus, it can be mentioned that the coupling portions 5, 9 may have another non-circular shape than those mentioned and shown, the coupling members 4, 8 may have other shapes than those described and shown and the container 12 may instead be a bracket or carrier for holding the package 1 and the discharge device 2 without containment thereof. The discharge device 2 may in a simple embodiment include or consist of a hose or a tube with or without a non-return valve device and the product 3 may be pressed or simply flow out through the hose or tube.

What is claimed is:

1. A device for dispensing a product (3), said device comprising:

an elongated package (1) made of yieldable material and containing the product (3), a discharge device (2) for discharging the product (3) from the package (I) when the package (1) is located in a container (12), the package (1) having an end portion (11) and a coupling member (4) with a coupling portion (5), the coupling member (4) being provided on the end portion (11) and being located within an unbroken portion (6) of a wall (7) of the package (1), the discharge device (2) having a conduit (13) for dispensing the product (3) from the package (1), the conduit (13) having a coupling member (8) with a coupling portion (9), the package (1) and the discharge device (2), before being located in the container (12), being connected to each other by placing the coupling member (8) on the conduit (13), the coupling member (8) penetrating the unbroken portion (6) of the wall (7) of the package (1) as the coupling member (8) cooperates with the coupling member (4) within the wall (7), the package (1) with the discharge device (2) connected to the package (1) being located in the container (12) such that the discharge device (2) is located in an upper part of the container (12), the end portion (11) of the package (1) with the coupling member (4) defining a lower portion of the package (1) when the package (1) is located within the container (12), the coupling portions (5, 9) of the coupling members (4, 8) having non-circular openings (19) such that the conduit (13) is placed in a predetermined position relative to the package (1), the conduit (13) being directed upwards in the container (12) from the end portion (11) of the package (1) to the discharge device (2) when the package (1) is located in the container (12), the non-circular opening of the coupling portion (9) of the coupling member (8) defining a non-circular exterior surface of the coupling portion (9), the non-circular exterior surface being complimentary to, and received by, the non-circular opening (19) of the coupling member (4), the non-circular opening (19) of the coupling portion (5) of the coupling member (4) defining a non-circular interior surface complimentary to the non-circular exterior surface of the coupling portion (9) of the coupling member (8), the non-circular interior surface receiving the coupling portion (9) of the coupling member (8), the non-circular exterior surface of the coupling portion (9) being shaped identically to the non-circular interior surface of the coupling portion (5).

2. The device according to claim 1 wherein the coupling portions (5, 9) are interconnected such that the conduit (13) is set in a position substantially parallel to a longitudinal direction of the package (1).

3. The device according to claim 1 wherein the opening of the coupling member (4) of the package (1) has a non-circular shape such that, if a coupling portion (9) of a coupling member (8) with a circular opening is connected to the coupling portion (5) on the coupling member (4) of the package (1), it is not possible to interconnect the coupling portions (5, 9) of the coupling members (4, 8).

4. The device according to claim 1 wherein the coupling portion (5) of the coupling member (4) of the package (1) has such a non-circular opening such that visual inspection may determine that the coupling portion (9) having a circular opening does not fit with the coupling portion (5) on the coupling member (4) of the package (1).

5. The device according to claim 1 wherein the coupling portion (9) of the coupling member (8) of the discharge device (2) has a tube member (20) with a non-circular opening for fitting into the opening (19).

6. The device according to claim 5 wherein the opening (19) of the coupling member (4) has an oval opening (19) and the tube member (20) has a corresponding oval opening.

7. The device according to claim 5 wherein the opening (19) has a partly circular, partly non-circular shape and the tube member (20) has a corresponding partly circular, partly non-circular opening.

8. The device according to claim 5 wherein the opening (19) has a polygonal shape and the tube member (20) has a corresponding polygonal opening.

9. The device according to claim 8 wherein the opening (19) has a heptagonal shape and the tube member (20) has a corresponding heptagonal opening.

10. The device according to claim 1 wherein the coupling member (4) of the package (1) has an outer part (26) provided on the unbroken portion (6) of the wall (7) of the package (1), the outer part (26) defining the coupling portion (5) on the coupling member (4) of the package (1), the coupling member (4) of the package (1) further having an inner annular part (27) located within the outer part (26), the outer part (26) and the inner annular part (27) being interconnected two connecting parts (28) defining openings (29) for through-flow of the product (3).

11. The device according to claim 10 wherein the outer part (26) has a substantially circular outer edge, the inner annular part (27) having an opening (30) for the product (3) and a substantially circular outer edge, the diameter of the outer edge of the outer part (26) being less than the diameter of the outer edge of the inner annular part (27), the connecting parts (28) being located opposite each other, the connecting parts (28) being connected to the outer edge of the outer part (26) and to the inner annular part (27) at the opening (30).

12. The device according to claim 10 wherein the outer part (26) has a collar (31) directed towards the inner annular part (27) and the connecting parts (28) are connected to an inner edge of the collar (31).

13. The device according to claim 1 wherein the discharge device (2) has pump device (14).

14. Device according to claim 13 wherein the pump device (14) has a suction (15) operated by a manual pump member (16) for pumping product (3) from the package (1).

15. A coupling assembly comprising:

an elongated package (1) made of synthetic material, a discharge device (2) for discharging a product (3) from the package (1) when the package (1) is located in a container (12), the package (1) having an end portion (11) and a coupling member (4) with a coupling portion (5), the coupling member (4) being provided on the end portion (11) and being located within an unbroken portion (6) of a wall (7) of the package (1), the discharge device (2) having a conduit (13) for dispensing the product (3) from the package (1), the conduit (13) having a coupling member (8) with a coupling portion (9), the package (1) and the discharge device (2), before being located in the container (12), being connected to each other by placing the coupling member (8) on the conduit (13), the coupling member (8) penetrating the unbroken portion (6) of the wall (7) of the package (1) as the coupling member (8) cooperates with the coupling member (4) within the wall (7), the package (1) with the discharge device (2) connected to the package (1) being located in the container (12) such that the discharge device (2) is located in an upper part of the container (12), the end portion (11) of the package (1) with the coupling member (4) defining a lower portion of the package (1) when the package (1) is located within the container (12), the coupling portions (5, 9) of the coupling members (4, 8) having non-circular openings (19) such that the conduit (13) is placed in a predetermined position relative to the package (1), the conduit (13) being directed upwards in the container (12) from the end portion (11) of the package (1) to the discharge device (2) when the package (1) is located in the container (12), the non-circular opening of the coupling portion (9) of the coupling member (8) defining a non-circular exterior surface of the coupling portion (9), the non-circular exterior surface being complimentary to, and received by, the non-circular opening (19) of the coupling member (4), the non-circular opening (19) of the coupling portion (5) of the coupling member (4) defining a non-circular interior surface complimentary to the non-circular exterior surface of the coupling portion (9) of the coupling member (8), the non-circular interior surface receiving the coupling portion (9) of the coupling member (8), the non-circular exterior surface of the coupling portion (9) being shaped identically to the non-circular interior surface of the coupling portion (5).

16. A method for dispensing product (3) from an elongated package (1), said method comprising the steps of:

making the package (1) from synthetic material, providing a discharge device (2) for discharging the product (3) from the package (1) when the package (1) is located in a container (12), the package (1) having a coupling member (4) with a coupling portion (5), the discharge device (2) having a conduit (13) for feeding the product (3) from the package (1), the conduit (13) having a coupling member (8) with a coupling portion (9), locating the coupling member (4) in the package (1) such that the coupling member is situated at a bottom of the container (12) when the package (1) is located in the container (12), locating the coupling member (4) of the package (1) within an unbroken portion (6) of a wall (7) of the package (1), connecting the coupling members (4, 8) of the package (1) and the discharge device (2) by penetrating the unbroken portion (6) of the wall (7) of the package (1), the coupling member (4) of the package (1) having an outer part (26), an inner annular part (27) and two connecting parts (28) connecting the outer part (26) and the inner annular part (27) such that the outer part (26), the inner annular part (27) and the connecting parts (28) define two outwardly open U-shaped grooves (47, 48) on opposite sides of the connecting parts (28), and guiding the coupling member (4) of the package (1) by two guide means (45, 46) forming part of a control device (44), the guide means (45, 46) engaging the two U-shaped grooves (47, 48) defined by the coupling member (4) such that the coupling member (4) may slide on the two U-shaped grooves.

17. The method according to claim 16 further including the step of guiding the coupling member (4) of the package (1) with a control device (44) such that the coupling member (4) is located on an inner side of the wall (7) of the package (1).

18. The method according to claim 17 further including the step of guiding the coupling member (4) of the package (1) by sliding the coupling member (4) along the guide means (45, 46) thereby forming part of the control device (44).

19. The method according to claim 16 further including the step of holding the coupling member (4) of the package (1) with the guide means (45, 46) prior to attachment of to the unbroken portion (6) of the wall (7) of the package (1).

20. The method according to claim 16 wherein the coupling members (4, 8) are connected only if the coupling portions (5, 9) each have non-circular openings (19).

* * * * *